United States Patent [19]

Dunsirn

[11] 4,151,797

[45] May 1, 1979

[54] DOCTOR BLADE APPARATUS

[75] Inventor: Duane R. Dunsirn, Neenah, Wis.

[73] Assignee: Mid America Tag and Label Company, Inc., Neenah, Wis.

[21] Appl. No.: 793,625

[22] Filed: May 4, 1977

[51] Int. Cl.[2] ..... B41N 9/00; B41L 27/06

[52] U.S. Cl. ..... 101/169; 15/256.51; 101/363; 101/425

[58] Field of Search ..... 101/157, 169, 363, 350, 101/425; 118/261, 126, 104; 15/256.51, 256.5

[56] References Cited

U.S. PATENT DOCUMENTS

| | | | |
|---|---|---|---|
| 2,638,844 | 5/1953 | Halley | 101/169 |
| 2,834,977 | 5/1958 | Wilson | 15/256.5 X |
| 2,914,788 | 12/1959 | Smith et al. | 15/256.51 |
| 3,144,674, | 8/1964 | Broughton | 15/256.5 |
| 3,377,644 | 4/1968 | Budzinski et al. | 15/256.51 X |
| 3,529,315 | 9/1970 | Dunlap et al. | 15/256.51 |
| 3,854,162 | 12/1974 | Russell | 15/256.51 |
| 3,866,266 | 2/1975 | Dunlap | 15/256.51 |

FOREIGN PATENT DOCUMENTS

| | | | |
|---|---|---|---|
| 1226160 | 3/1971 | United Kingdom | 15/256.51 |

*Primary Examiner*—J. Reed Fisher
*Attorney, Agent, or Firm*—Harry C. Engstrom; Theodore J. Long; Nicholas J. Seay

[57] ABSTRACT

Doctor blade apparatus having a mounting plate rigidly holding the blade. The doctor blade mounting plate is independently slidably and pivotably mounted by a ball-bearing on each of a plurality of spaced support ports and resiliently supported thereon by compression springs. The apparatus allows movement of the mounting plate and the blade carried thereby in several degrees of freedom with adjustment means providing independent adjustment at each of the supporting posts.

17 Claims, 4 Drawing Figures

DOCTOR BLADE APPARATUS

BACKGROUND OF THE INVENTION

1. Field of the Invention

This invention pertains generally to the field of printing and decorating processes and more particularly to the use and mounting of doctor blades in connection with printing processes.

2. Description of the Prior Art

Doctor blades are used in a variety of printing processes, most commonly in the rotogravure or intaglio type processes. The printing design is formed in recesses on a printing plate with ink being applied to the printing plate to fill the recesses. The excess ink must usually be removed with a blade of some sort so that ink will be applied to the printed surface only from the recessed areas of the plate. Depending on the printing technique, the doctor blade may be employed as a wiper, in which the blade is oriented away from the direction of rotation of the roller, or as a scraper, in which the blade meets the roller in an orientation which is against the direction of rotation of the roller. As used herein, the term doctor blade will refer to either a wiper or scraper type blade.

Doctor blades may also be utilized in other printing processes. For example, in flexographic printing where the amount of ink in each cell of an anilox metering roller must be precisely controlled, a doctor blade may be utilized to remove excess ink from the anilox metering roller.

In the utilization of a doctor blade for either scraping or wiping the surface of the roller, it is desirable to maintain a reasonably constant pressure of the blade against the roller as the roller rotates, as well as providing uniform pressure along the entire length of the blade. The uniform pressure of the blade against the roller provides an even coating of the surface of the roller with ink, so that the work being printed does not have portions thereof with unusually heavy coats of ink while other portions of the printed work do not have enough ink. The pressure of the doctor blade against the roller must be uniformly maintained despite the displacements and compressions of rollers which take place when the various rollers of a press are engaged to begin printing. Often, the typical fixedly mounted doctor blades will not follow the distortions of the roller and will tend to apply greater pressure to one part of the roller than to other parts of the roller. The result is the distorted application of ink on the printed object as described above. The problem of displacement or rollers becomes particularly evident where the rollers are cantilever mounted, since such rollers have less rigidity than rollers which are mounted at both ends.

The pressure of the doctor blade on the roller should be substantially constant despite small displacements of the roller and the incremental wearing away of the edge of the doctor blade and possibly the surface of the roller. In prior doctor blade mounting systems, this pressure has typically been controlled by providing a thin doctor blade which is bent against the surface of the roller to apply spring pressure. Other methods of maintaining the pressure of the blade against the roller have been utilized. For example, the blade may be mounted so that it can be rotated into contact with the roller, with either springs or hydraulic cylinders applying a controlled amount of torque to the mounting of the doctor blade to control the pressure of the doctor blade against the roller. With the use of these mounting techniques, the doctor blade can generally move in only one degree of freedom, rotation about a longitudinal axis, i.e. an axis parallel to the long direction of the doctor blade and the axis of rotation of the roller. Such systems have inherent limitations in that they allow adjustment only of the pressure of the entire doctor blade against the roller, and do not allow adjustment of the pressure of portions of the doctor blade to account for misalignments between the axes of the doctor blade and the roller, and minor displacements of the roller. Such systems also have difficulty maintaining relatively light pressures of the doctor blade on the roller surface.

SUMMARY OF THE INVENTION

My invention maintains a doctor blade in contact with the surface of a roller at substantially uniform pressures along the blade, despite minor displacements of the roller from its normal position. Substantially constant overall pressure of the blade against the rollers is maintained during these movements of the roller.

In my apparatus, the doctor blade is firmly and rigidly held by a mounting plate. The mounting plate itself is mounted to a firmly positioned base by support means which allow the mounting plate to rotate or tilt resiliently about longitudinal and lateral axes. These two degrees of rotational freedom allow the doctor blade to rotate upwardly or downwardly as the roller surface is closer or further away from the blade, respectively. The mounting plate and doctor blade have an additional degree of freedom in resilient linear elevational movement with respect to the plane of the mounting plate. However, linear lateral and longitudinal movement of the mounting plate is resisted, as well as rotational movement of the plate around an elevational axis, that is, an axis perpendicular to the mounting plate.

In a preferred embodiment, a plurality of upright support posts (four shown) are rigidly mounted to the base in spaced relation. These posts are slidably received by an interior opening of the ball portion of a ball and socket bearing. The socket portion of each bearing is fit into a hole in the mounting plate. Thus, the plate is supported on these bearings to the extent that it cannot be moved laterally or longitudinally, or rotated about an elevational axis. However, the ball and socket arrangement allows the plate limited rotational movement about lateral and longitudinal axes, and the movement of the balls on the support posts allows linear elevational movement of the plate on the posts.

Preferably, two springs are mounted around each of the posts, one between the base and the plate and the other between the plate and an adjustment knob threaded on the top of the post. The adjustment knob is utilized to apply varying degrees of pressure to the springs. Since the pressure between the springs and any one post will be equalized, the portion of the plate at the post being adjusted will assume elevational position on the post depending on the position of the adjustment knob. Thus, the plurality of adjustment knobs can be individually adjusted to set the initial position of the mounting plate and the doctor blade carried thereby. Any deviations of the doctor blade and mounting plate from their initial position will be resisted by the springs, and the springs will return the plate and blade to their initial position once the displacing force has been removed. In this embodiment of my invention, the tolerances allowed in the mountings between the posts and the ball, the ball and the socket, and between the socket itself and the hole in the plate in which it is inserted, allow free rotational displacements of the plate over limited angles, while resisting any substantial lateral or longitudinal movement of the plate in its own plane.

The base itself is formed to slide laterally within the channel of a guideway member while being otherwise firmly held therein, such that lateral adjustments to the position of the doctor blade may be made. The guideway is held at one end by a slotted fixed holder which is itself firmly mounted to the frame of the press or to some other rigid structure. The fixed holder is constructed so as to require insertion of the guideway into the slot from the top thereof, to minimize the danger of accidentally jamming the sharp doctor blade into one of the rollers of the press during installation or removal of the doctor blade apparatus. An adjustment screw is provided on the guideway member to precisely and firmly adjust the lateral position of the base to a position selected by the operator.

Further objects, features, and advantages of my invention will be apparent from the following detailed description, taken in conjunction with the accompanying drawings showing a preferred embodiment of a doctor blade apparatus exemplifying the principles of my invention.

DESCRIPTION OF A PREFERRED EMBODIMENT

Figure 1:
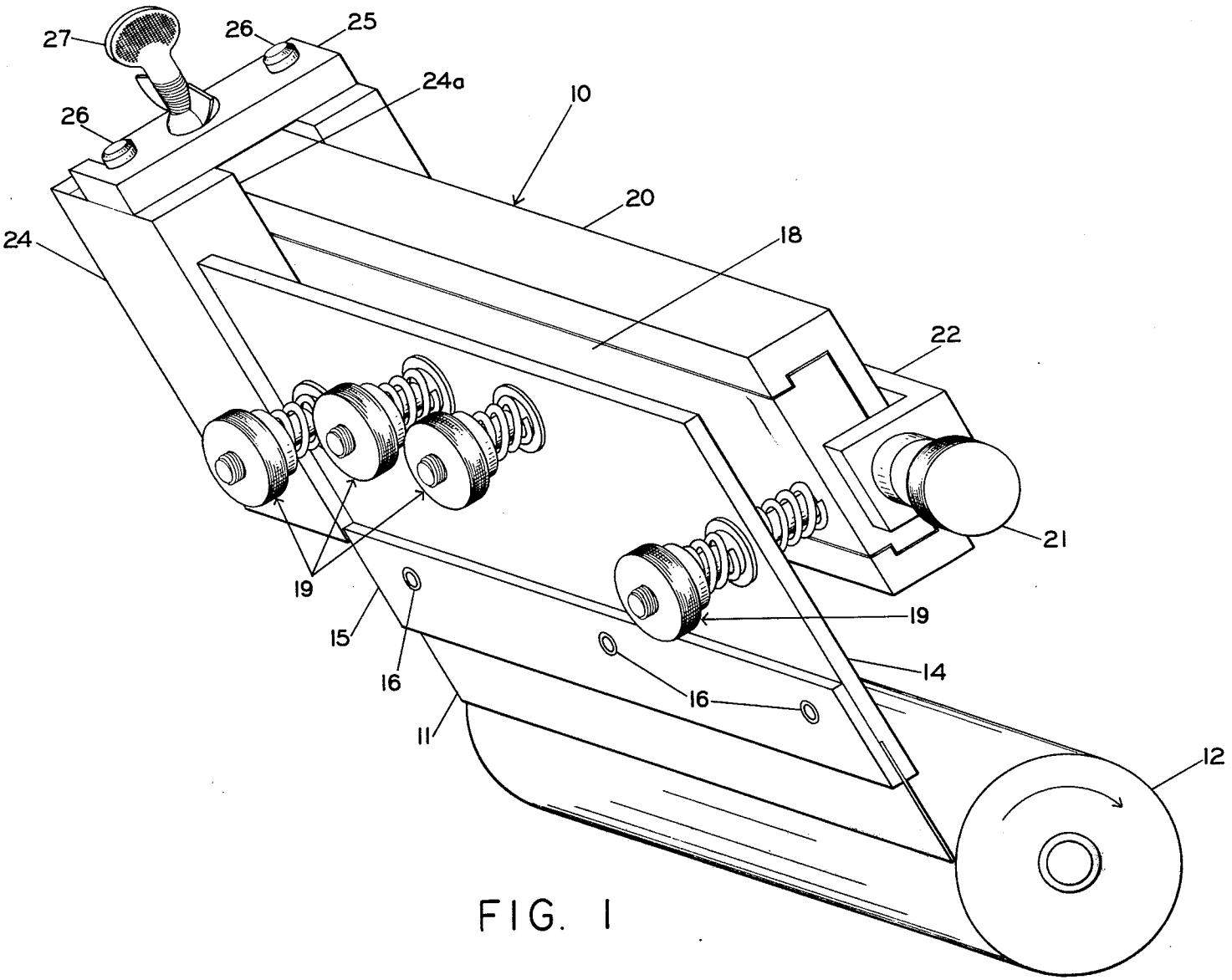
FIG. 1 is an oblique projection view of my doctor blade apparatus shown in position to scrape the surface of a printing press roller.

Referring now more particularly to the drawings, wherein like numerals refer to like parts throughout the several views, a preferred embodiment of my doctor blade apparatus is shown generally at 10 in FIG. 1. For illustrative purposes, my apparatus is shown with a doctor blade 11 mounted in position to engage the surface of a roller 12. As noted above, the roller may be any of the various types of printing and decorating rollers which utilize doctor blades to either scrape or wipe the surface thereof to insure uniformity of application of material on the surface of the roller. The doctor blade itself may be any of the various types of doctor blades utilized in such processes, which are typically formed of spring steel.

The doctor blade 11 is firmly and rigidly mounted to a mounting plate 14, preferably by being held between the plate 14 and an attaching plate 15. As shown in FIG. 1, the attaching plate has a small indentation formed in one edge thereof into which the doctor blade closely fits, and the attaching plate is firmly screwed down to the mounting plate over the doctor blade by set screws 16. This attachment of the doctor blade allows for easy and quick replacement of a worn out blade. The doctor blade can be equivalently mounted to the plate by any other attaching means which firmly and rigidly mounts the blade on the mounting plate.

The doctor blade 11 generally forms a plane which intersects the surface of the roller 12 along a straight line on the periphery of the roller to evenly scrape or wipe the surface of the roller. In order to maintain uniform pressure of the blade on the roller after the blade is adjusted to a desired set position, it is necessary that the blade not be subject to any significant movement in its own plane, i.e., lateral and longitudinal movements of the blade. For some doctor blade applications it may be desirable to be able to adjust the pressure of the blade so that the blade rides upon a layer of printing liquid to reduce friction and avoid damage to the roller itself. Generally, the prime objective of the mounting of the doctor blade is to maintain constant pressure of the blade upon the roller during the printing operation, to thereby insure that a uniform allowance of ink will be left on the roller for printing.

Again referring to FIG. 1, the mounting plate 14 is itself mounted to a base 18 by a plurality of adjustable supports 19. As will be described in greater detail below, the adjustable supports allow the mounting plate and the doctor blade to move in elevational position as well as allowing limited pivotal motion about lateral and longitudinal axes when a displacing force is applied to the doctor blade. The supports resiliently hold the mounting plate and doctor blade in an initially selected position, that is, the supports tend to urge the doctor blade and mounting plate to their initial set position when they are displaced therefrom in any of their three degrees of rotational and elevational freedom. Moreover, these supports prevent linear lateral and longitudinal movement of the mounting plate and doctor blade, as well as preventing rotation of the plate and blade about an elevational axis. The supports are also adjustable so as to allow adjustment of the pressure to be applied by the doctor blade to the roller along the longitudinal length of the doctor blade, and to allow adjustment of the overall pressure of the doctor blade against the surface of the roller.

The base 18 is preferably formed as a "Tee" bar which rides within a similarly shaped channel of a guideway 20. The base is thus firmly held in the guideway so as to prevent any movement of the base except in a longitudinal direction along the channel of the guideway. The position of the base in the guideway is adjusted by means of an adjustable threaded screw 21 which is rotably mounted to a brace 22 affixed to the guideway. The screw 21 is threadingly engaged with the base such that rotation of the screw will draw the base outwardly or push it inwardly depending on the direction of rotation of the screw to precisely locate the doctor blade 11 in the proper position on the surface of the roller 12. It is also apparent that the mounting plate 14 and doctor blade 11 could be oscillated longitudinally by providing an oscillator to move the base. Such oscillation of the doctor blade may be desired in some types of printing processes.

Figure 2:
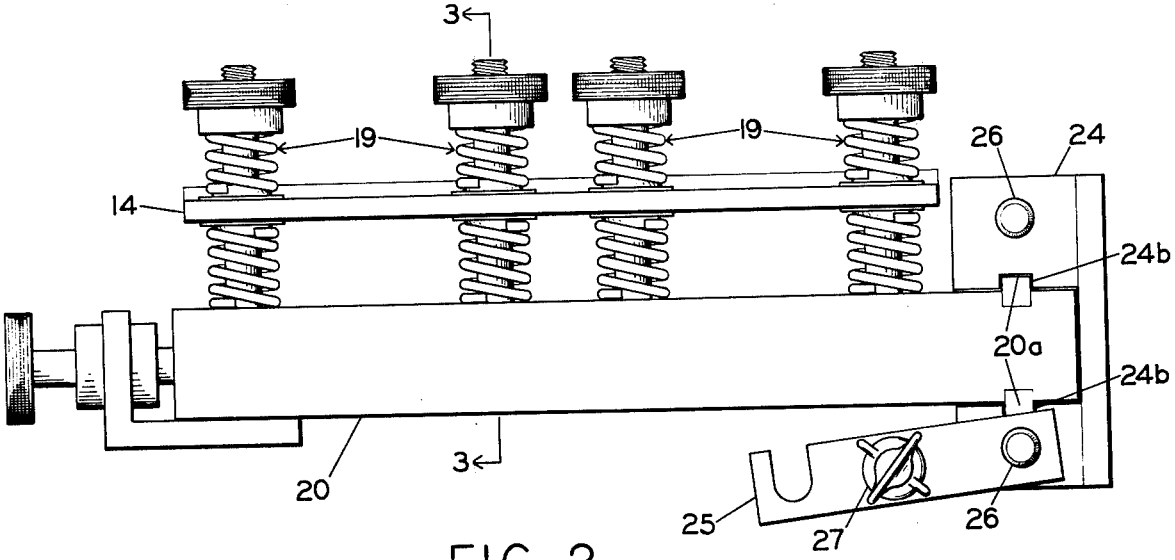
FIG. 2 is a front elevational view of my apparatus.

The guideway 20, with the base 18 therein, is itself mounted in its proper position on a press in a fixed holder 24 which is rigidly mounted on the frame of a press (not shown). The holder has a slot **24*a* formed therein into which the guideway is inserted from above. As best shown in the view of FIG. 2, the guideway has ridged keys 20*a* formed thereon which fit into keyways 24*b* formed in the holder along the opposite sides of the slot 24*a***. The guideway is thus firmly held to prevent sideways or outward motion.

Figure 4:
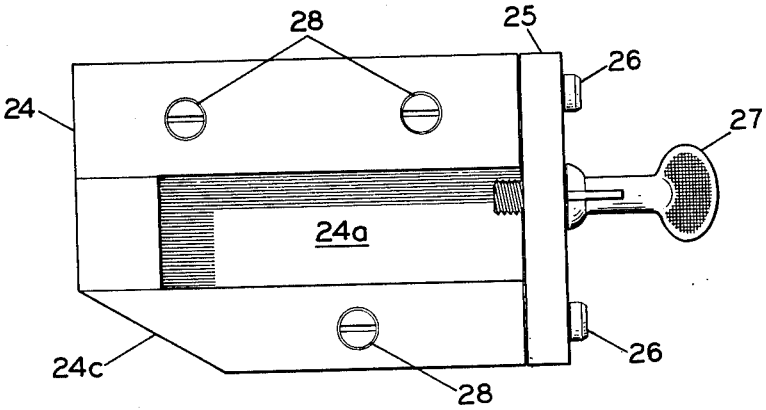
FIG. 4 is a front elevational view of the fixed holder portion of my apparatus.

Provision for insertion of the guideway 20 from above into the slot **24*a* of the fixed holder 24 is important in preventing damage to the rollers. For example, if the attachment of the doctor blade apparatus to the press frame required inserting the guideway from the side of the frame, th sharp edged doctor blade could accidentally slice the roller surface. Insertion of the guideway into the slot of the holder from above eliminates the possibility that the blade may accidentally come into contact with other rollers of the press, or that it may accidentally be jammed into the roller that it is being applied to. Once the guideway has been inserted all the way into the slot 24***a*, a locking mechanism having a latch 25 is swung over the top of the slot 24*a* and secured by finger screws 26. A wing nut and thumb screw combination 27 is threaded through the latch 25 into contact with the guideway 20 to lock the same in position. The fixed holder 24 is firmly mounted to a press frame (not shown) or other support by mounting screws 28. The holder 24 may have an end thereof beveled off, as shown in FIG. 4 at 24*c*, to facilitate mounting of the holder on the frame at a chosen angle. During mounting, the beveled edge 24*c* is abutted against a vertical surface on the press and the screws 28 are tightened to affix the holder in its proper position.

Figure 3:
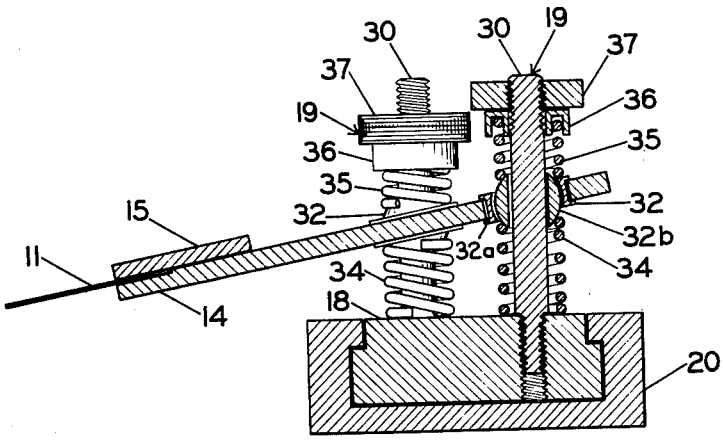
FIG. 3 is a cross sectional view of my apparatus taken along the line 3—3 of FIG. 2, showing the doctor blade and mounting plate therefor set at a canted angle.

The construction and operation of the adjustable supports 19 is best shown with reference to the cross sectional view of FIG. 3. Each of the adjustable supports 19 has a support post 30 which is preferably threaded into the base 18 and extends upwardly therefrom. The mounting plate 14 is mounted to each of the posts by a ball and socket bearing 32. The bearing consists of a socket portion 32*a* which is mounted within an opening in the mounting plate, and a ball portion 32*b* which is fitted within the socket to rotate freely therein. The ball has a central opening large enough to allow the post to be inserted therein, so that the ball can slide up and down on the post.

Each ball and socket bearing 32, considered individually, provides the mounting plate 14 with freedom of rotation around either a longitudinal or a lateral axis, while allowing the plate to move up and down in elevational movement without impedance. However, the bearings obviously provide no vertical support for the mounting plate. As best shown in FIGS. 2 and 3, to provide such vertical support, and to individually locate the mounting plate on each of the posts 30, the plate is supported from below by a lower support spring 34, and is retained in position from above by an upper support spring 35. The upper support spring is retained in position on the post by a retention cap 36, which itself is held in place by an adjustment knob 37 threaded to the top of the post 30.

At each post, the adjustment knob 37 associated therewith exerts a force on the upper spring 35 which will tend to compress and force the mounting plate 14 downwardly against the lower spring 34. Thus, the adjustment knob can be utilized to adjust the elevational position of the mounting plate at each of the posts. It is also apparent that displacements of the mounting plate away from its initial position will be resiliently resisted by the springs 34 or 35, and that the plate will be urged back to the initial position by these springs once the disturbing force has been removed. It is preferred that four posts are affixed to the base in spaced relation as shown such that they do not align in a straight line. Such spacing of the posts allows the plate to be rotated about both lateral and longitudinal axes by changing the elevational position of the adjustment knobs 37 at the proper posts. The manner in which my apparatus provides for limited rotational movement of the mounting plate 14 and doctor blade 11 about longitudinal and lateral axes is best disclosed with reference to the cross sectional view of FIG. 3. The two supports shown in FIG. 3 are spaced apart laterally a fixed distance. It is clear from the geometry of the device that as the mounting plate rotates from a position which is perpendicular to the posts 30, to a rotated or canted position, the center points of the holes in the plate 14 must move closer together horizontally. Since the posts 30 are a fixed distance apart horizontally, this would seem to preclude any rotational movement of the plate 14. This would, in fact, be substantially the case if the bearings 32 were not utilized and if the posts 30 simply fit into close tolerance holes in the plate 14. If this constuction was utilized, any rotational movement of the plate 14 would bring the walls of the hole in the plate into contact with the posts 30. The only way even limited rotational movements of the plate 14 could be obtained would be make the holes in the plate much larger than the diameter of the posts 35, which would allow some limited rotation of the plate 14 but would also, of course, result in substantial lateral "slop" of the plate 14 such that the doctor blade could never be maintained in a constant position on a rotating roller.

The ball and socket bearings 32, utilized as a part of my supports 19, allow the desired limited rotational movement of the plate while substantially preventing any lateral or longitudinal movement of the plate. As shown in somewhat exaggerated terms in FIG. 3, there is a slight amount of tolerance between the opening in the ball portion 32*b* and the posts 30, and some tolerance between the ball 32*b* and the socket of the socket portion 32*a*. These tolerances are necessary and unavoidable in order to allow slippage of the plate 14 up and down on the posts 30 and rotational movement of the ball within the socket. However, no significant lateral or longitudinal planar displacement of the plate 14 is allowed despite the presence of such tolerances. For example, for a typical construction wherein the posts 30 are approximately ¼ inch in diameter, the total tolerances between the posts and the opening in the ball 32*b*, and between the ball and the socket 32*a*, will be in the range of 0.005 to 0.010 of an inch. As long as any pressure at all is maintained on the doctor blade 11, the bearings 32 will be pressed up tight against the posts 30, so that further lateral and longitudinal movement of the plate 14 cannot take place as a result of pressures applied against the doctor blade by the roller. However, these relatively tight tolerances, in the range of 0.010 of an inch or less at each support 19, are sufficient to allow rotational movement of the plate over a substantial range. For example, with the arrangement of supports shown in FIG. 1, the cumulative effect of 0.010 of an inch of tolerance at each of the supports 19 would be sufficient to allow plus or minus 10 degrees of rotation about a longitudinal axis where the front and rear supports are spaced approximately 1 inch apart. Approximately 3 to 4 degrees of rotation in each direction will be allowed about a lateral axis where the outside supports 19 are spaced longitudinally approximately 6 inches apart. This free movement of the plate 14 over a limited but substantial range of rotational motion is allowed because the plate can rotate independently about the bearings 32 at each post.

The adjustment knobs 37 can be utilized in the manner shown in FIG. 3 to apply pressure on the top spring 35 to move the plate downwardly at the particular support 19 that is being adjusted. In this manner, all of the supports 19 can be individually adjusted to set the plate 14 and doctor blade 11 at an initial position. This initial position will be maintained until an exterior force, such as that applied by the surface of the roller 12, displaces the plate and doctor blade from their initial position. The springs 34 and 35 will tend to resiliently urge the plate back to the original position once the displacing force is removed. With the doctor blade 11 held flush against the surface of a roller, the adjustment of the position of the knobs 37 on the suppports 19 can be utilized to selectively apply greater or lesser pressure to various portions of the doctor blade against the roller, even though the position of the plate and doctor blade is not substantially changed.

It is understood that my invention is not confined to the particular construction and arrangement of parts herein illustrated and described, but embraces all such modified forms thereof as come within the scope of the following claims.

I claim:

1. Apparatus for supporting a doctor blade in position against the surface of a roller having an axis of rotation, comprising:

(a) mounting means for firmly holding a doctor blade;

(b) a base;

(c) support means for supporting said mounting means on said base including a plurality of posts mounted to and extending from said base in an elevational direction, said support means engaging said mounting means so as to permit linear elevational motion of said mounting means on said posts and rotational motion thereof around a longitudinal axis parallel to the axis of rotation of the roller and around a lateral axis through said mounting means, said support means preventing linear motion of said mounting means along the lateral and longitudinal axes and rotational motion around an elevational axis parallel to said posts; and (d) means for resiliently urging said mounting means back to an initial position when displaced from such initial position in any motion permitted by said support means.

2. The apparatus of claim 1 wherein said doctor blade mounting means includes a substantially planar mounting plate and attaching means for firmly attaching a doctor blade to said mounting plate.

3. The apparatus of claim 2 wherein said mounting plate has a plurality of holes formed therein in position to align with and receive said posts, and including bearing means for engaging said plate to said posts to allow elevational movement of said plate along said posts and rotational movement of said plate around each individual post while substantially preventing linear movement of said plate by said posts along the lateral and longitudinal axes.

4. The apparatus of claim 3 wherein said means for resiliently urging said mounting means back to an initial position includes resilient means for resiliently supporting said plate above said base at each of said posts and resiliently urging said plate downward at each of said posts toward said base to an initial position.

5. The apparatus of claim 2 including a doctor blade mounted by said attaching means to said plate.

6. The apparatus of claim 1 including means for selectively adjusting the position of said base in a direction along the longitudinal axis.

7. The apparatus of claim 1 including a guideway having a channel therein extending parallel to the longitudinal axis, and wherein said base is received in said channel of said guideway for sliding longitudinal movement of said base therein, and also including adjustment means mounted to said guideway and engaged with said base for adjusting and maintaining the longitudinal position of said base.

8. The apparatus of claim 7 including a fixed holder attachable to the frame of a printing press and including therein a slot slidingly receiving said guideway with said base therein, said holder holding said guideway and base therein within said slot in a position wherein a doctor blade held by said mounting means is in position to contact a roller of a printing press.

9. Doctor blade apparatus for supporting a doctor blade in position against the surface of a roller having an axis of rotation, comprising:

(a) a base;

(b) a plurality of posts affixed to and extending from said base;

(c) a mounting plate having a plurality of holes therein in position to align with and receive said posts;

(d) attaching means for firmly attaching a doctor blade to said mounting plate;

(e) bearing means, mounted to said plate in each of said holes in said plate, for receiving and engaging said posts to allow said plate to move along each individual post toward and away from said base in elevational movement and to allow rotational movement of said plate around a longitudinal axis parallel to the axis of rotation of the roller and around a lateral axis through said plate, while engaging said posts to substantially prevent linear movement of said plate along the lateral and longitudinal axes and rotational motion around an elevational axis parallel to said posts;

(f) a plurality of lower support springs each mounted at one of said posts between said base and said plate to provide support for said plate;

(g) a plurality of upper support springs each mounted at one of said posts above said mounting plate; and (h) adjustment means engaged to each of said posts for adjustable upward and downward positioning thereon in engagement with said upper spring, whereby adjustment of the position of said adjustment means at each of said posts determines the elevational position of said mounting plate above said base at each said post.

10. The apparatus of claim 9 wherein said adjustment means comprises an adjustment knob threadingly engaged to the top of each of said posts and providing upward and downward movement on said post by rotation thereof.

11. The apparatus of claim 9 wherein said bearing means include a socket firmly mounted to each of said holes in said plate and having a generally spherical interior opening therein, and a ball rotatable in said socket, said ball having a central opening therein receiving and slidingly engaging said posts, wherein the tolerances in said bearings allow no substantial linear lateral or longitudinal movement of said plate but provide for a substantial range of rotational movement of said plate about the lateral and longitudinal axes.

12. The apparatus of claim 9 wherein said apparatus has at least three posts affixed to and extending upwardly from said base, said posts not being aligned in a straight line.

13. The apparatus of claim 9 including a doctor blade affixed to said plate by said attaching means.

14. The apparatus of claim 9 wherein said attaching means includes an attaching plate positioned on top of said mounting plate and having an indented portion therein shaped to receive a doctor blade, and also including a plurality of screws threadingly engaged through said attaching plate to said mounting plate to firmly engage said attaching plate to said mounting plate with said doctor blade mounted therebetween.

15. The apparatus of claim 9 including a guideway having a channel therein receiving and holding said base for sliding longitudinal movement thereof, and including a threaded adjustment screw mounted to said guideway and threadingly engaged with said base such that rotation of said adjustment screw selectively adjusts the longitudinal position of said base within the channel of said guideway.

16. The apparatus of claim 15 including a fixed holder attachable to a printing press, and having a slotted opening therein engaging and slidingly receiving said guideway with said base therein at one end of said guideway and maintaining and holding said guideway and base therein within said slotted opening.

17. The apparatus of claim 16 wherein said guideway has ridged keys formed on one end thereof, and wherein said fixed holder has keyways formed along the sides of the slotted opening therein adapted to receive the ridged keys on said guideway, and wherein said guideway slides into said slotted opening with said ridged keys in engagement with said keyways in said holder whereby a doctor blade held by said mounting plate may be inserted into engagement with a roller of a printing press in proper position without accidentally engaging any of the other rollers of the press.

* * * * *